US010386058B1

(12) United States Patent
Cattoni et al.

(10) Patent No.: US 10,386,058 B1
(45) Date of Patent: Aug. 20, 2019

(54) LED LUMINAIRE

(71) Applicants: Shat-R-Shield, Inc., Salisbury, NC (US); Nicor, Inc., Albuquerque, NM (US)

(72) Inventors: Don Cattoni, Huntersville, NC (US); Rocklan E. Lawrence, Albuquerque, NM (US)

(73) Assignees: Shat-R-Shield, Inc., Salisbury, NC (US); Nicor, Inc., Albuquerque, NM (US)

( * ) Notice: Subject to any disclaimer, the term of this patent is extended or adjusted under 35 U.S.C. 154(b) by 0 days.

(21) Appl. No.: 15/145,237

(22) Filed: May 3, 2016

Related U.S. Application Data

(60) Provisional application No. 62/309,636, filed on Mar. 17, 2016.

(51) Int. Cl.

| | |
|---|---|
| ***F21V 1/00*** | (2006.01) |
| ***F21V 29/87*** | (2015.01) |
| ***F21V 29/76*** | (2015.01) |
| ***F21V 15/01*** | (2006.01) |
| ***F21V 23/02*** | (2006.01) |
| ***F21V 5/04*** | (2006.01) |
| *F21Y 101/02* | (2006.01) |

(52) U.S. Cl.
CPC ..... *F21V 29/87* (2015.01); *F21V 5/048* (2013.01); *F21V 15/01* (2013.01); *F21V 23/023* (2013.01); *F21V 29/763* (2015.01); *F21Y 2101/02* (2013.01)

(58) Field of Classification Search
CPC ..... F21Y 2101/02; F21K 9/00; F21S 3/003
USPC ..... 362/235
See application file for complete search history.

(56) References Cited

U.S. PATENT DOCUMENTS

| | | | |
|---|---|---|---|
| 7,287,347 | B2 | 10/2007 | Hasan |
| 7,422,338 | B2 | 9/2008 | Kono et al. |
| 7,527,400 | B2 | 5/2009 | Yamamoto et al. |

(Continued)

FOREIGN PATENT DOCUMENTS

| | | | |
|---|---|---|---|
| JP | 2014229430 | A | 12/2014 |
| KR | 101201153 | B1 | 11/2012 |

(Continued)

OTHER PUBLICATIONS

Howard Lighting HL03012RW HL0301 Series LED Slimline Thermoplastic Exit Sign Red Letters 120/277V AC Only; https://www.shineretrofits.com/howard-lighting-hl03012tw-hl0301-series-led-slimeline-thermoplastic-exit-sign-red-letters-120-277v-ac-only.html; accessed Sep. 29, 2015; all enclosed pages cited.

(Continued)

*Primary Examiner* — Ahshik Kim
(74) *Attorney, Agent, or Firm* — Nelson Mullins Riley & Scarborough LLP

(57) ABSTRACT

A luminaire having corrosion resistant and vapor tight properties. The luminaire comprises a first lighting module having a first housing with heat sink fins located thereon, a second lighting module having a second housing with heat sink fins located thereon, a raised junction box affixed between the first lighting module and the second lighting module, and at least one LED containing printed circuit board in each of the first lighting module and the second lighting module. The first housing and the second housing are each comprised of a thermally conductive plastic resin material.

24 Claims, 15 Drawing Sheets

(56) References Cited

U.S. PATENT DOCUMENTS

| | | | | |
|---|---|---|---|---|
| 7,682,036 | B2 | 3/2010 | Reiff et al. | |
| 7,794,103 | B2 | 9/2010 | Hoover | |
| 8,029,162 | B2 | 10/2011 | Curran et al. | |
| 8,066,402 | B2 | 11/2011 | Klipstein | |
| 8,097,221 | B2 | 1/2012 | Incorvia et al. | |
| 8,197,098 | B2 | 6/2012 | Cook | |
| 8,376,602 | B2 | 2/2013 | Klipstein | |
| 8,403,526 | B2 | 3/2013 | Bayat et al. | |
| 8,459,831 | B2 | 6/2013 | Hsia et al. | |
| 8,579,462 | B2 | 11/2013 | VanDuinen et al. | |
| 8,672,506 | B2 | 3/2014 | Chen | |
| 8,721,110 | B2 | 5/2014 | Luo | |
| 8,764,238 | B2 | 7/2014 | Brukilacchio | |
| 8,876,333 | B1 * | 11/2014 | Rashidi | F21V 29/2231 362/294 |
| 8,898,940 | B1 | 12/2014 | Hasan | |
| 9,004,715 | B1 | 4/2015 | Litke et al. | |
| 9,080,745 | B2 | 7/2015 | Quaal et al. | |
| 9,097,412 | B1 | 8/2015 | Pinato | |
| 2008/0304284 | A1 | 12/2008 | Guo et al. | |
| 2010/0014282 | A1 | 1/2010 | Danesh | |
| 2011/0095690 | A1 * | 4/2011 | Sagal | B29C 45/14 315/113 |
| 2011/0110086 | A1 * | 5/2011 | Barnwell | F21V 33/006 362/249.02 |
| 2012/0057348 | A1 | 3/2012 | Ruud et al. | |
| 2012/0307501 | A1 | 12/2012 | Tankala et al. | |
| 2013/0057141 | A1 | 3/2013 | Van De Ven et al. | |
| 2013/0069100 | A1 | 3/2013 | Ahmed et al. | |
| 2013/0094207 | A1 | 4/2013 | Negandhi et al. | |
| 2013/0286675 | A1 | 10/2013 | Hasan et al. | |
| 2013/0301266 | A1 | 11/2013 | Poissonnet et al. | |
| 2013/0314921 | A1 | 11/2013 | Chen | |
| 2013/0329434 | A1 | 12/2013 | Packard et al. | |
| 2014/0098542 | A1 | 4/2014 | Zimmer et al. | |
| 2014/0204570 | A1 | 7/2014 | Burmeister et al. | |
| 2014/0211474 | A1 | 7/2014 | Juan et al. | |
| 2014/0268830 | A1 | 9/2014 | Boyer et al. | |
| 2014/0347846 | A1 | 11/2014 | Ahn et al. | |
| 2015/0008549 | A1 | 1/2015 | Lee et al. | |
| 2015/0085493 | A1 | 3/2015 | Sun et al. | |
| 2015/0092425 | A1 | 4/2015 | Thompson, III et al. | |
| 2015/0131294 | A1 | 5/2015 | Kuenzler et al. | |
| 2015/0184808 | A1 | 7/2015 | Wang et al. | |
| 2015/0338077 | A1 * | 11/2015 | Johnson | F21V 23/005 362/234 |
| 2016/0003464 | A1 | 1/2016 | Thomas et al. | |
| 2017/0045198 | A1 * | 2/2017 | Ruiz De Apodaca Cardenosa | H01L 33/52 |

FOREIGN PATENT DOCUMENTS

| | | | |
|---|---|---|---|
| WO | 2012175263 | A1 | 12/2012 |
| WO | WO 2013/124315 | A1 | 8/2013 |

OTHER PUBLICATIONS

Explosion Proof Lights; Larson Electronics; http://www.larsonelectronics.com/c-154-explosion-%5broof-lights.aspx?ph=&pclld=CMm44cLPnMgCFZWJaQodiZIDvQ; accessed Sep. 29, 2015; all enclosed pages cited.

Explosionproof LED Globe; Energy Focus; http://www.energyfocusinc.com/wp-content/uploads/EF_Mil-ExplosionGlobe.pdf; all enclosed pages cited.

International Search Report and Written Opinion for corresponding PCT Patent Application No. PCT/US2017/029058, dated Jul. 6, 2017, all enclosed pages cited.

* cited by examiner

LED LUMINAIRE

CROSS-REFERENCE TO RELATED APPLICATIONS

This application claims priority from U.S. patent application Ser. No. 62/309,636, filed on Mar. 17, 2016, in the United States Patent and Trademark Office. The disclosure of which is incorporated herein by reference in its entirety.

FIELD OF THE INVENTION

The present invention relates to a luminaire, more particularly to a LED luminaire having vapor tight and corrosion resistant properties.

BACKGROUND OF THE INVENTION

Lighting fixtures or luminaires are typically made from cast aluminum housings. Cast aluminum housings are used to dissipate heat that is generated by the light source and the power supply to energize that source. In the case of light-emitting diode (LED) lighting fixtures, it is extremely important and imperative that the junction temperature of the LED is maintained within the temperatures that are reported in LM80 data supplied by the LED manufacturer. If the temperature is not maintained and exceeds the allowable threshold, the life of the LED diminishes substantially, the color characteristics can change, and the lumen output decreases.

Existing cast aluminum fixtures are a good solution for dissipating heat because aluminum has very good theimal conductive properties that transfer the heat away from the LED light engine to maintain a desired junction temperature of the LED. While this aluminum housing is good at heat dissipation, it is not very good at corrosion resistance, has design limitations, and is heavy. Poorly designed aluminum heat sink housings with the use of higher power LEDs can create many of these problems.

Corrosion is a significant issue and a problem for aluminum lighting fixtures. There have been advances made in coating aluminum fixtures to help against corrosion which include expensive multi-stage coatings but these are still susceptible to corrosion in environments that have salt and other types of chemicals and contaminants. These aluminum fixtures can easily deteriorate from both the outside due to the failure of the coating and the inside of the fixture which does not have a protective coating. Another disadvantage of the aluminum LED fixture housing is material cost and the need to perform secondary operations for assembly.

Thus, there is a need for a type of lighting fixture that is corrosion resistant inside and outside and yet solves the existing issues with aluminum LED fixtures including high cost and high weight.

SUMMARY OF THE INVENTION

The present invention relates to a light-emitting diode (LED) luminaire. In an embodiment of the invention, the LED luminaire is corrosion resistant. In another embodiment of the invention, the LED luminaire is vapor tight.

In an aspect of the invention, a luminaire comprises a first lighting module having a first housing with a first set of heat sink fins on the first housing, a second lighting module having a second housing with a second set of heat sink fins on the second housing, a junction box affixed between the first lighting module and the second lighting module, and at least one printed circuit board having a LED located thereon in each of the first housing and the second housing.

In another aspect of the invention, a luminaire comprises a first lighting module having a first housing comprised of a thermally conductive plastic resin with a first set of heat sink fins on the first housing, a second lighting module having a second housing comprised of the thermally conductive material with a second set of heat sink fins on the second housing, a junction box affixed between the first lighting module and the second lighting module, a heat transfer plate housed within the junction box, and at least one printed circuit board having LEDs located thereon in each of the first housing and the second housing.

In still yet another aspect of the invention, a luminaire comprises a first lighting module having a first housing with a first set of heat sink fins on the first housing, a second lighting module having a second housing with a second set of heat sink fins on the second housing, a junction box affixed between the first lighting module and the second lighting module, at least one LED printed circuit board located in each of the first housing and the second housing, a first lens diffuser in the first lighting module, and a second lens diffuser in the second lighting module.

Further aspects of the present invention and areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, which are not necessarily to scale, wherein.

DESCRIPTION OF THE PREFERRED EMBODIMENTS

The following description of the embodiments of the present invention is merely exemplary in nature and is in no way intended to limit the invention, its application, or uses. The present invention has broad potential application and utility, which is contemplated to be adaptable across a wide range of industries. The following description is provided herein solely by way of example for purposes of providing an enabling disclosure of the invention, but does not limit the scope or substance of the invention In an embodiment of the invention, a luminaire comprising a printed circuit board(s) having light-emitting diodes (LEDs) located thereon is provided. The luminaire effectively dissipates heat from the LEDs, provides additional protection from corrosion, and has a major reduction in weight and cost. The luminaire of the invention is comprised primarily of thermally conductive plastic components and eliminates the need for a metal housing for the luminaire. The luminaire is corrosion resistant without the need for a secondary coating as used with metal housings to help protect the metal housings from corrosion. The luminaire is suitable to be used in harsh environments which also include raised ambient temperature up to 50 degrees Celsius and extreme cold temperatures −40° C.

Figure 1:
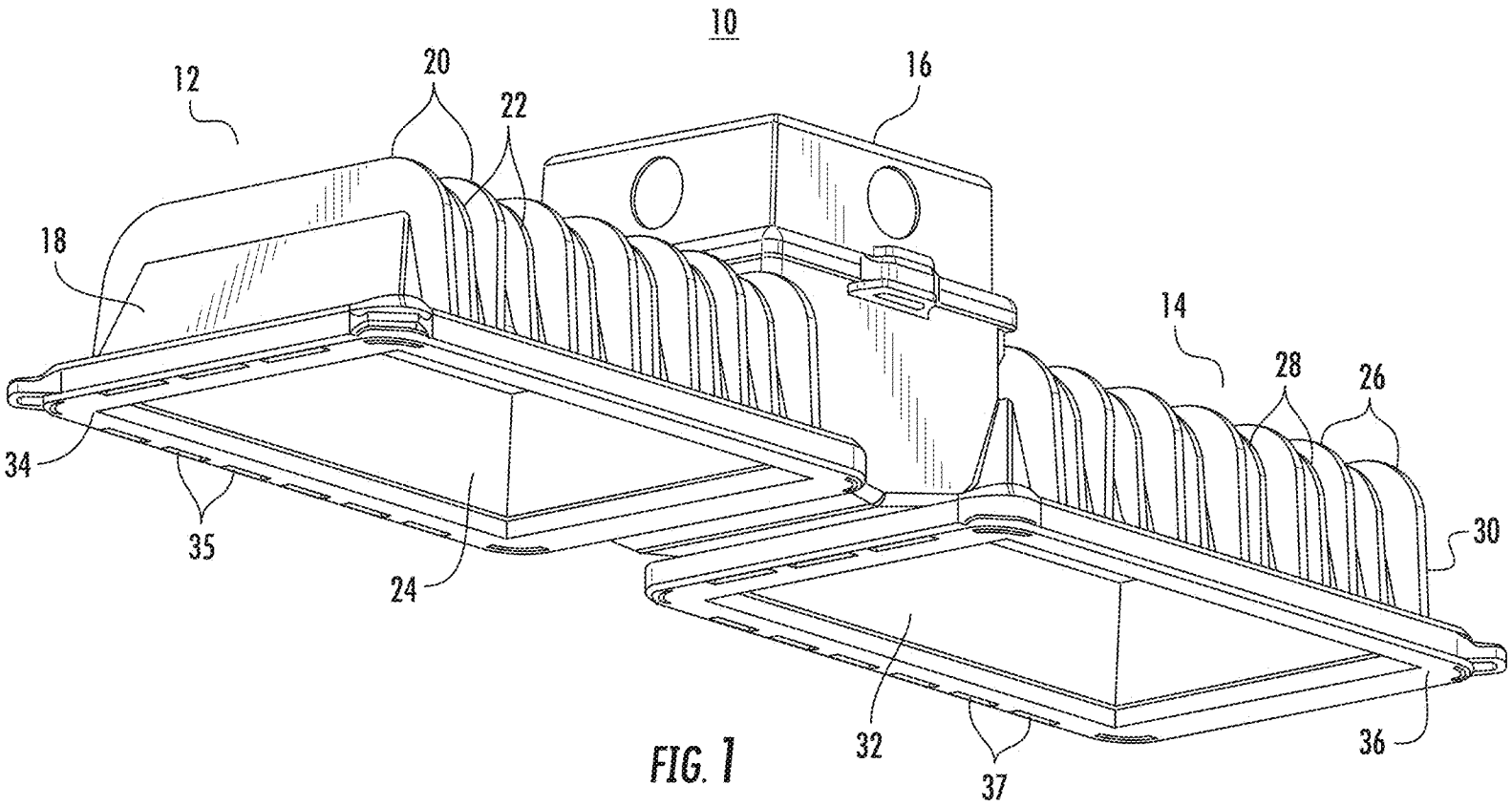
FIG. 1 is a perspective view of a luminaire in accordance with aspects of the invention.

Referring to the figures, FIG. 1 is a perspective view of a luminaire 10 in accordance with aspects of the invention. As shown in FIG. 1, luminaire 10 generally comprises a driver box or junction box 16, a first lighting module 12, and a second lighting module 14.

As shown in FIG. 1, first lighting module 12 and second lighting module 14 are joined by junction box 16. The junction box is comprised of a thermally conductive plastic resin or a non-conductive plastic resin, provided the plastic resin meets UL requirements for high voltage power supply since the junction box comprises a LED driver power supply. As shown in FIG. 1, junction box 16 is positioned to be higher than the first and second lighting modules 12 and 14 allowing for heat dissipation such as when the luminaire is mounted flush up against a ceiling, for example.

As shown in FIG. 1, first lighting module 12 comprises a first housing 18. Preferably, first housing 18 is a molded housing. Preferably, the housing is beveled along its edges to allow water to easily roll off. First housing 18 comprises a set of raised heat sink fins 20 and lowered heat sink fins 22. The heat sink fins 20 and 22 are preferably tapered to allow water to easily roll off. Raised heat sink fins 20 preferably alternate with lowered heat sink fins 22. First lighting module 12 further comprises a lens diffuser 24. Preferably, lens diffuser 24 is a high transmissivity lens diffuser. Lens diffuser 24 is held in place by a lens frame 34 having one or more weep holes 35 for drainage. Lens frame 34 is connected to first housing 18 when assembled.

Second lighting module 14 comprises a second housing 30. Preferably, second housing 30 is a molded housing. Preferably, the housing is beveled along its edges to allow water to easily roll off. Second housing 30 comprises a set of raised heat sink fins 26 and lowered heat sink fins 28. The heat sink fins 26 and 28 are preferably tapered to allow water to easily roll off. Raised heat sink fins 26 preferably alternate with lowered heat sink fins 28. Second lighting module 14 further comprises a lens diffuser 32. Preferably, lens diffuser 32 is a high transmissivity lens diffuser. Lens diffuser 32 is held in place by a lens frame 36 having one or more weep holes 37 for drainage. Lens frame 36 is connected to second housing 30 when assembled.

Heat sink fins 20, 22 and 26, 28, respectively, are used to increase the surface area and transfer the heat to allow for natural convection to assist in heat dissipation. It is a unique feature of luminaire 10 to have heat sink fins 20, 22 and 26, 28, respectively, having alternating heights with one raised and one lower. Heat sink fins 20, 22 and 26, 28, respectively, improve heat dissipation and natural convection for cooling.

Each of lighting modules 12 and 14 has a lens diffuser 24 and 32, respectively, to produce a uniform, glare-free illumination and to eliminate LED hotspots commonly seen in traditional LED lighting fixtures. In a preferred aspect of the invention, lens diffuser 24 and/or 32 is a high transmissivity lens diffuser such as greater than 80%. In another preferred aspect of the invention, lens diffuser 24 and/or 32 is comprised of a material that is UL rated for both indoor and outdoor applications. Examples of such materials for the lens diffuser include, but are not limited to, polystyrene, polycarbonate, polymethyl methacrylate (PMMA), tempered safety glass, or a combination thereof. Preferably, the lens diffuser(s) is frosted and is comprised of high transmissivity polystyrene.

Luminaire 10 has a substantially reduced size as compared to existing fluorescent fixtures for which it is intended to replace. Luminaire 10 has overall dimensions of approximately 22 inches (length)×6.8 inches (width)×5.25 inches (height). In contrast, a typical fluorescent fixture is 52 inches (length)×14.5 inches (width) and 6 inches (height). The compact size of luminaire 10 allows for maximum design and allows for a single person to install the luminaire instead of multiple persons for the existing fixtures, saving both time and cost.

As noted, luminaire 10 is compact and lightweight for the amount of lumen output. Luminaire 10 has a weight in a range of approximately 4 pounds to 6 pounds, preferably approximately 5 pounds. A typical 4 lamp T8 vapor tight fixture weighs 24 pounds. Thus, luminaire 10 achieves a significant weight reduction as compared to a traditional aluminum fixture.

Figure 2:
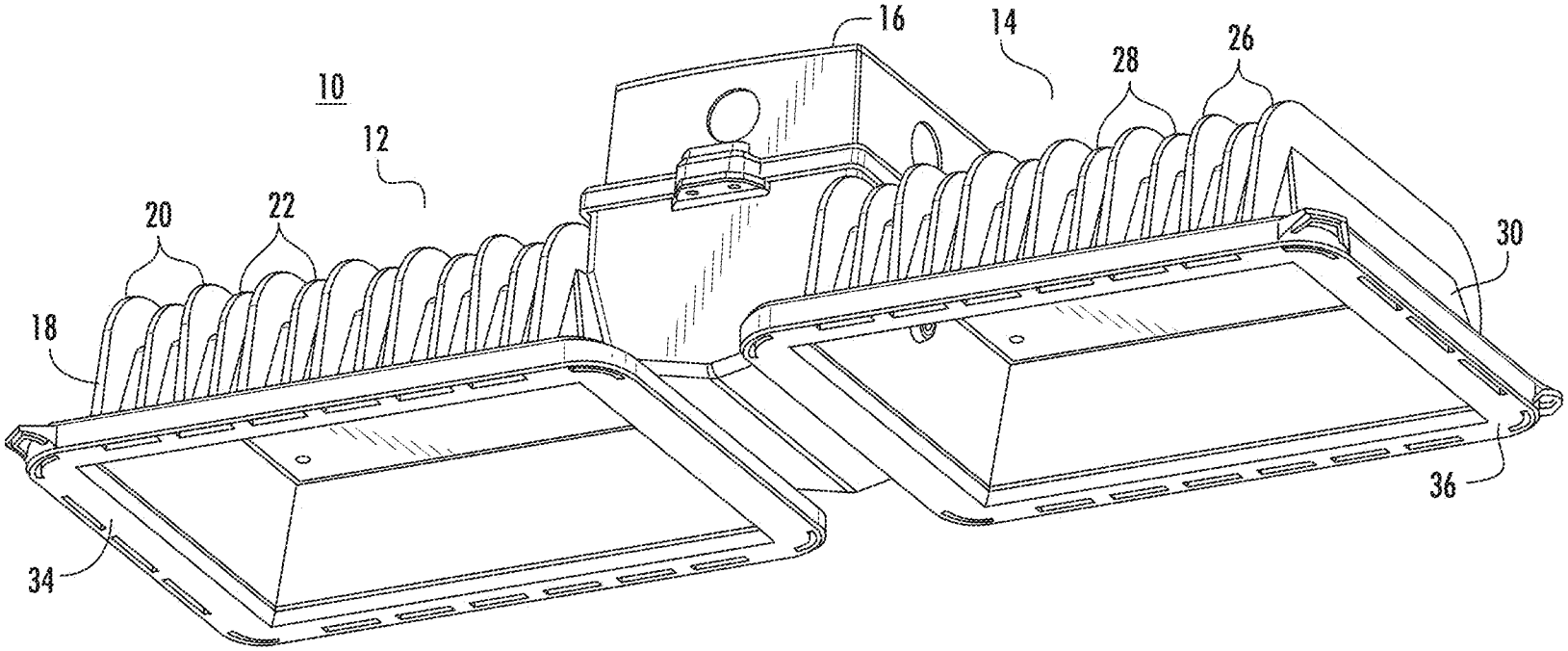
FIG. 2 is a full bottom view of the luminaire of FIG. 1 in accordance with aspects of the invention.

FIG. 2 is a full bottom view of luminaire 10 of FIG. 1 in accordance with aspects of the invention. Junction box 16 is elevated and raised higher than the first and second lighting modules 12 and 14. FIG. 2 illustrates a bottom view of luminaire 10 from below first lighting module 12 and second lighting module 14. FIG. 2 illustrates alternating raised heat sink fins 20 and lowered heat sink fins 22 on first housing 18 of first lighting module 12. First housing 18 is shown as being connected to lens frame 34. FIG. 2 also illustrates alternating raised heat sink fins 26 and lowered heat sink fins 28 on second housing 30 of second lighting module 14. Second housing 30 is shown as being connected to lens frame 36.

Figure 3:
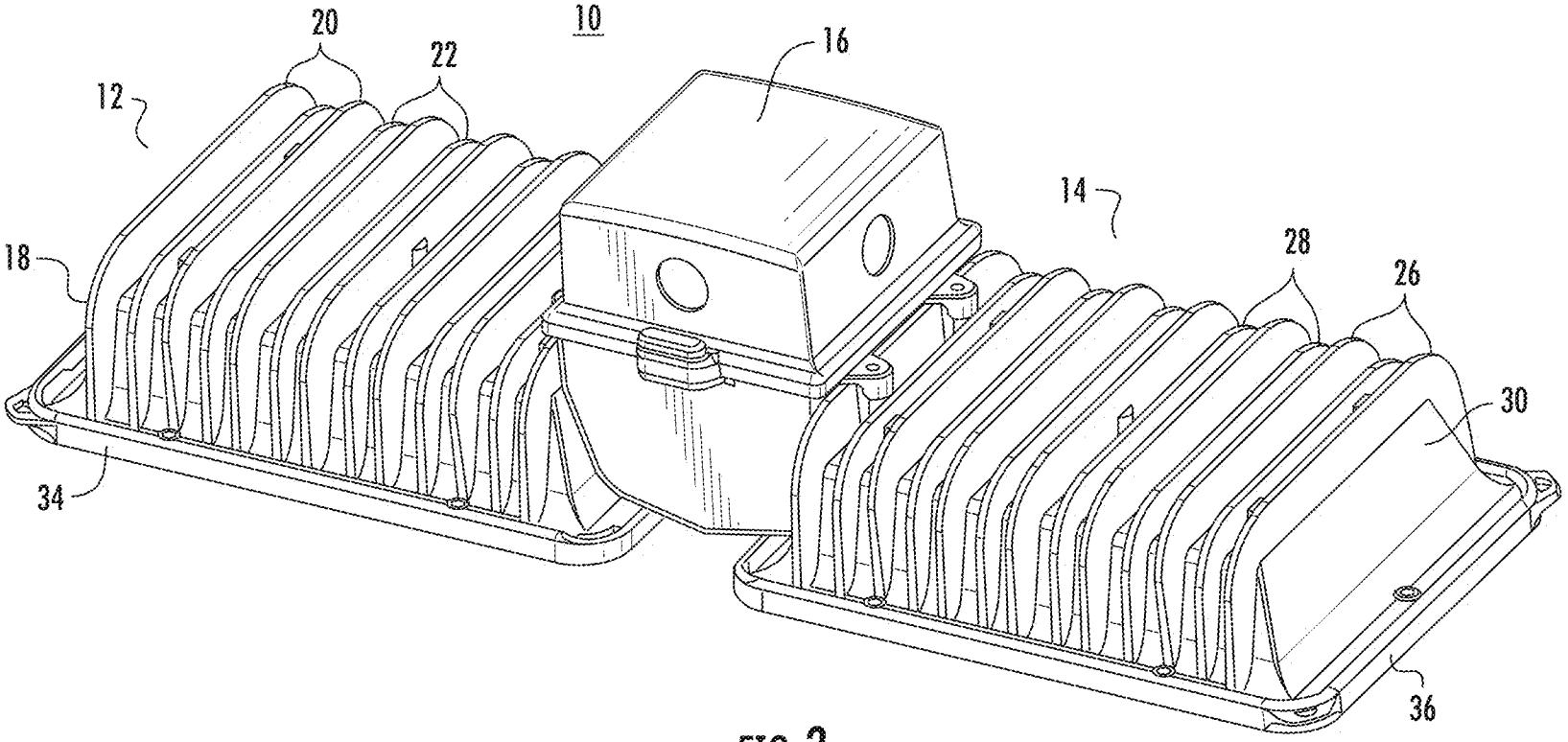
FIG. 3 is a full top view of the luminaire of FIG. 1 in accordance with aspects of the invention.

FIG. 3 is a full top view of luminaire 10 of FIG. 1 in accordance with aspects of the invention. FIG. 3 illustrates luminaire 10 comprising junction box 16, first lighting module 12 having first housing 18 with alternating raised heat sink fins 20 and lowered heat sink fins 22 thereon, second lighting module 14 having second housing 30 with alternating raised heat sink fins 26 and lowered heat sink fins 28 thereon. Lens frame 34 connected to first housing 18, and lens frame 36 connected to second housing 30 is also shown.

Figure 4:
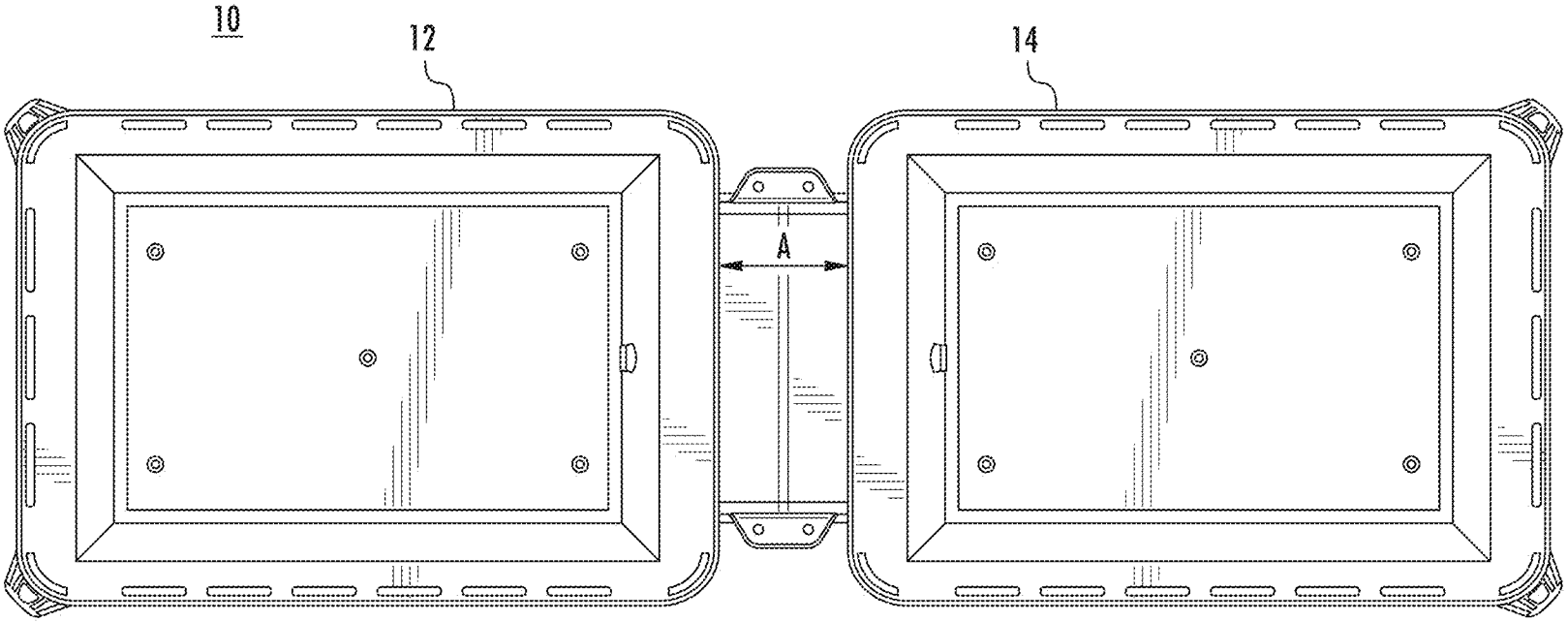
FIG. 4 is a bottom view of the luminaire of FIG. 1 in accordance with aspects of the invention.

FIG. 4 is a bottom view of luminaire 10 of FIG. 1 in accordance with aspects of the invention. FIG. 4 illustrates the underside of luminaire 10 comprising first lighting module 12 and second lighting module 14. Spacing A illustrates the distance in the horizontal direction between first lighting module 12 and second lighting module 14. The spacing may vary depending upon the size of the junction box needed for a specified lumen output. As shown, spacing assists with heat dissipation from LEDs of the printed circuit boards housed within each of first lighting module 12 and second lighting module 14.

Figure 5:
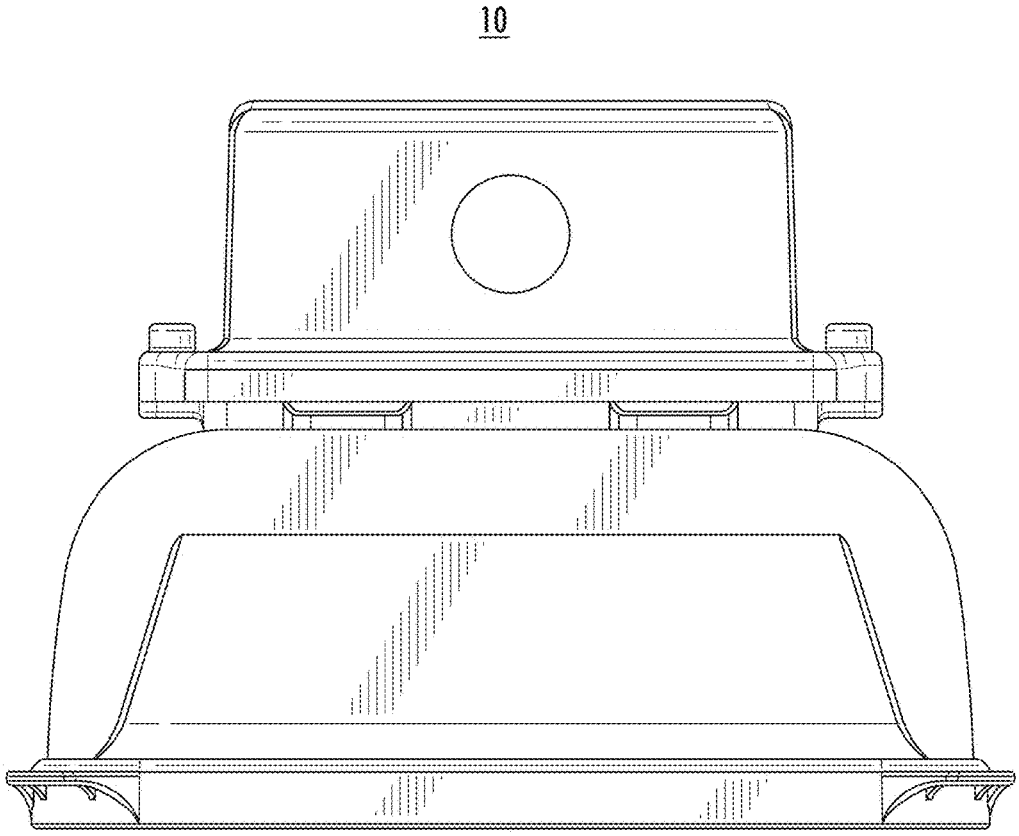
FIG. 5 is an end view of the luminaire of FIG. 1 in accordance with aspects of the invention.

FIG. 5 is an end view of luminaire 10 of FIG. 1 in accordance with aspects of the invention.

Figure 6:
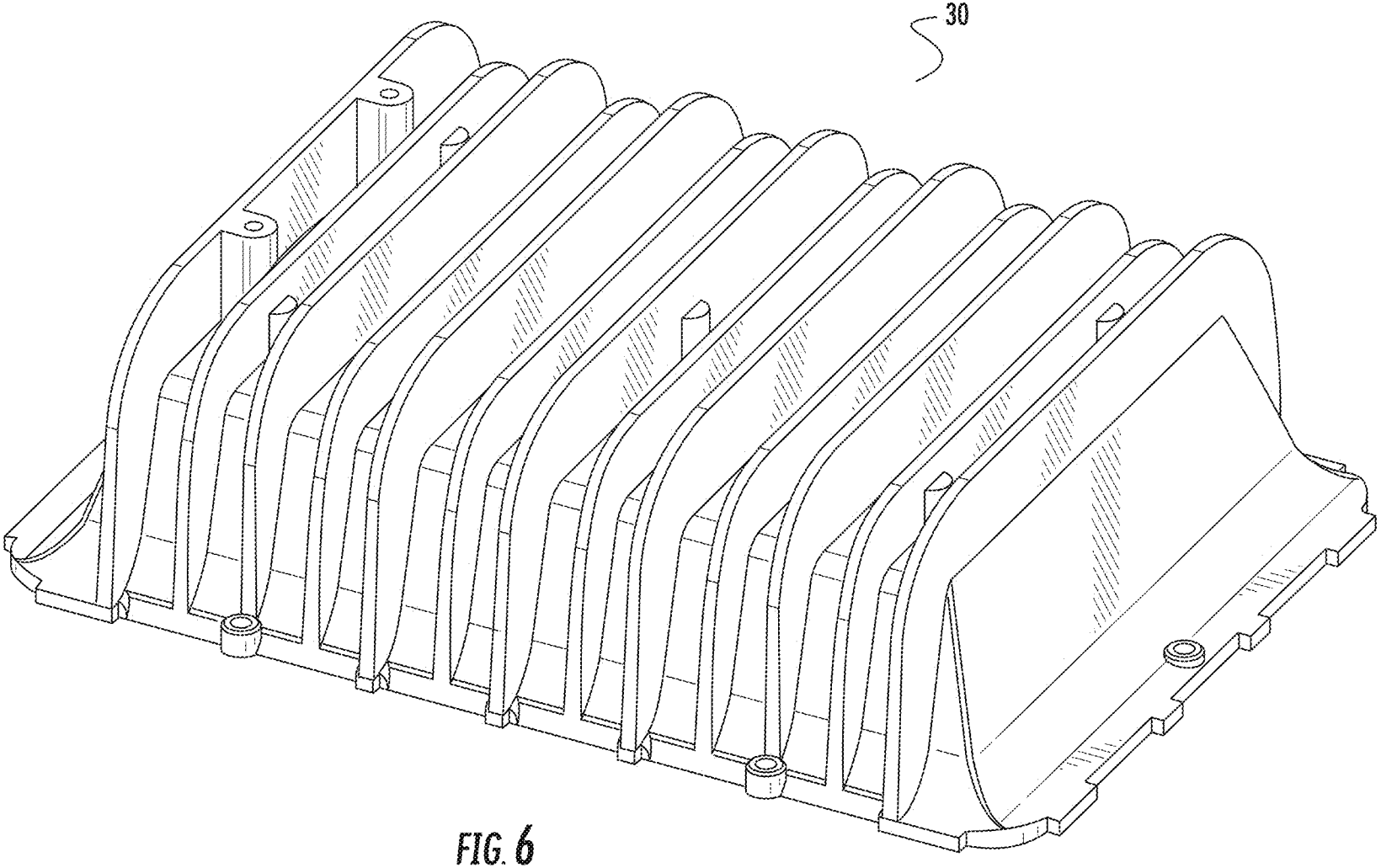
FIG. 6 is a top view of a housing of the luminaire in accordance with aspects of the invention.

FIG. 6 is a top view of second housing 30 of luminaire 10 in accordance with aspects of the invention. First housing 18 is preferably of the same physical construction as second housing 30 but first housing 18 would be assembled in an opposing direction 180 degrees from second housing 30.

Figure 7:
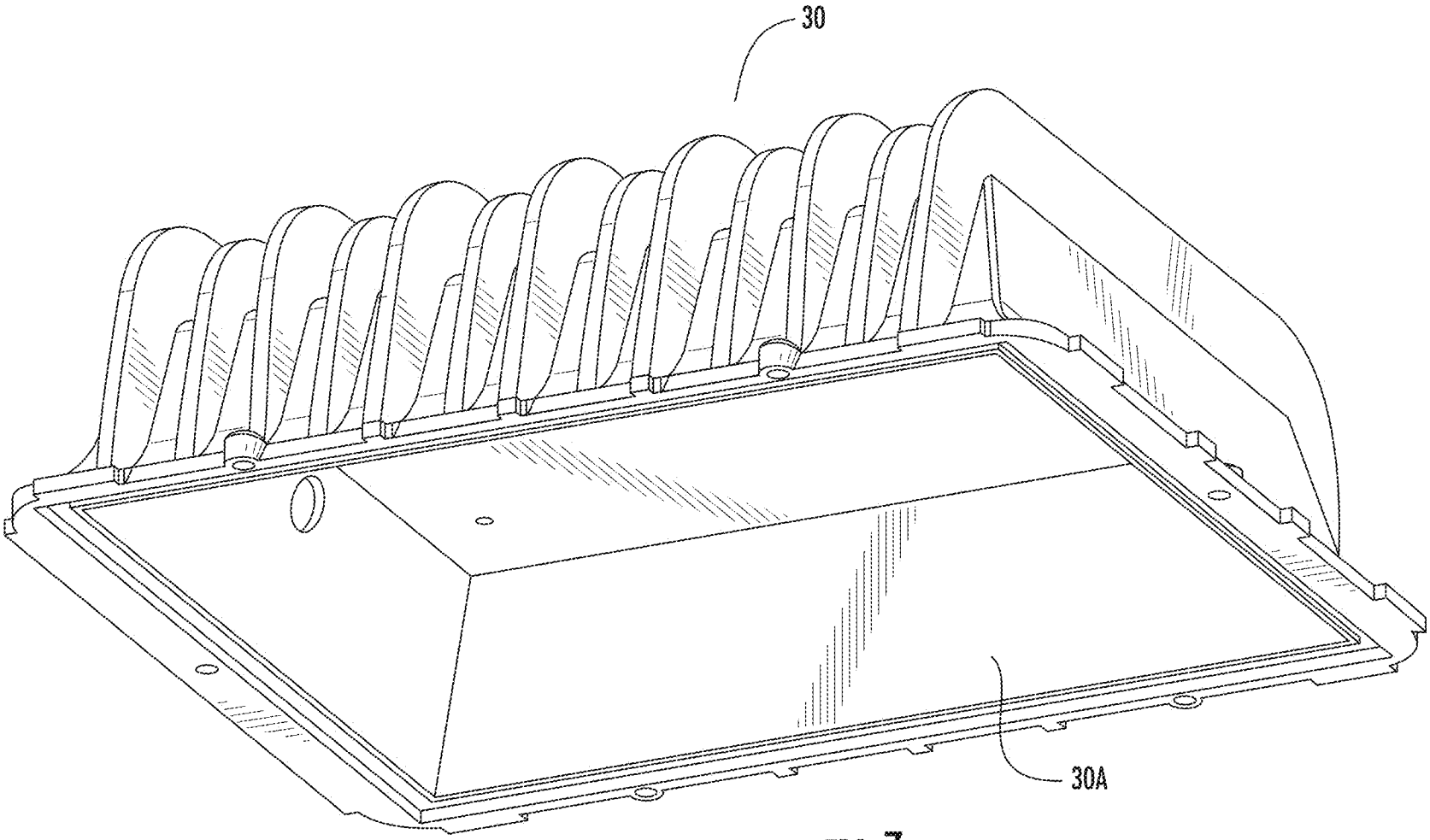
FIG. 7 is a bottom view of a housing of the luminaire of FIG. 1 in accordance with aspects of the invention.

FIG. 7 is a bottom view of second housing 30 of luminaire 10 of FIG. 1 in accordance with aspects of the invention. As shown, second housing 30 has a chamber or a pocket 30A in which to mount the LED board away from the front surface of the lens diffuser to allow for a high transmissivity efficient lens to be used and eliminate the "hot spot" glare that LEDs produce. This allows for an extremely even distribution of light emitted from the luminaire and eliminates glare.

Figure 8:
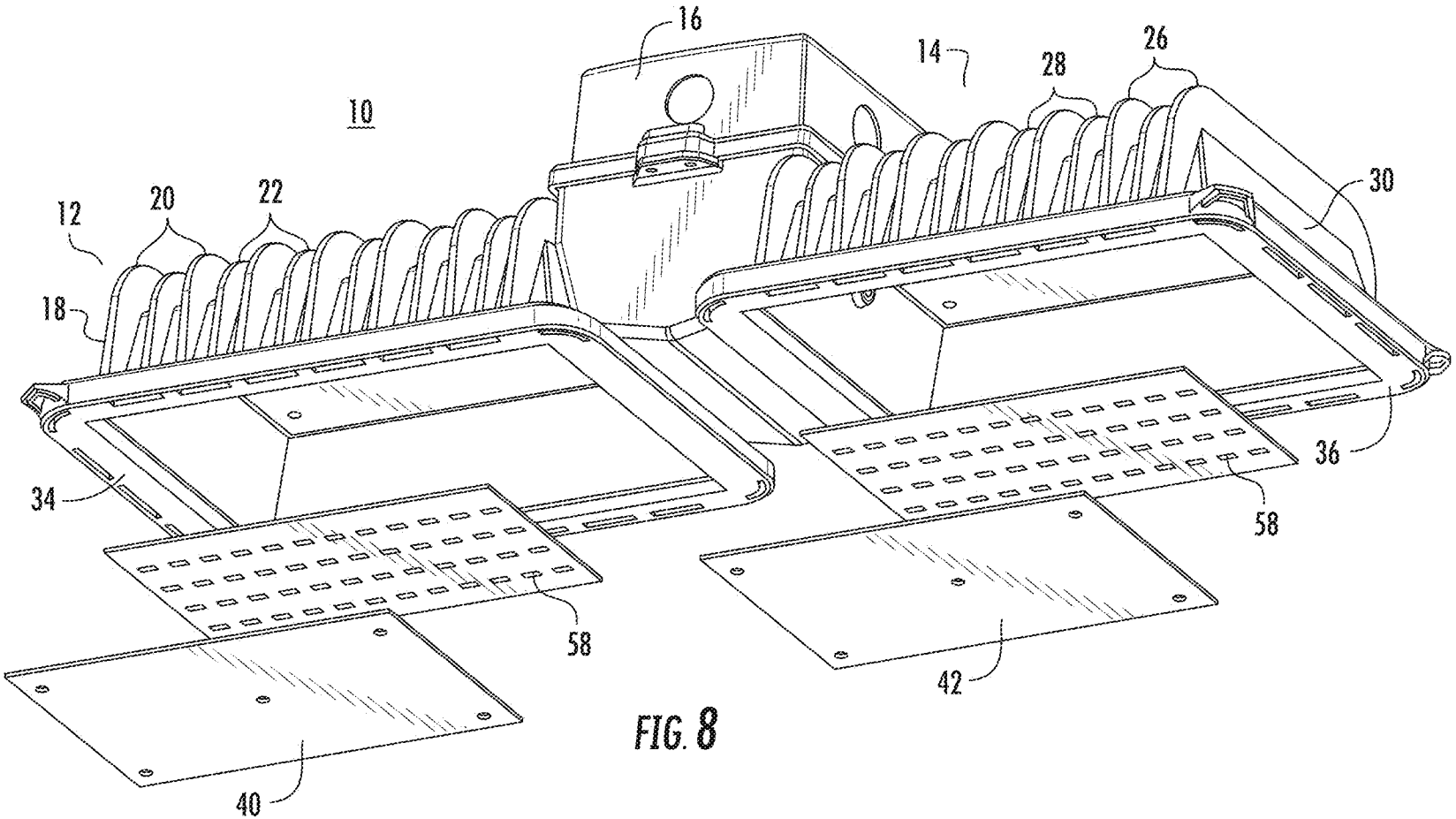
FIG. 8 is a bottom exploded view of the luminaire of FIG. 1 illustrating LED printed circuit boards in accordance with aspects of the invention.

FIG. 8 is a bottom exploded view of luminaire 10 of FIG. 1 illustrating printed circuit boards 40 and 42 having LEDs 58 mounted thereon in accordance with aspects of the invention.

Luminaire 10 can be of varying light output. In an aspect of the invention, luminaire 10 has a light output of 3500 lumens. In another aspect of the invention, luminaire 10 has a light output of 7000 lumens. As a feature of luminaire 10, mid-power LEDs are used to evenly distribute the heat generated from each LED. An example of such type of LED is a Nichia LEMWS59R80HZ2B. However, many mid-power LEDs comparable in lumens per watt can be used in the luminaire of the invention.

Luminaire 10 having a 3500 lumen output preferably comprises two LED boards, one for each of the first lighting module and the second lighting module. Due to the lower lumen output as compared to luminaire 10 having a 7000 lumen output, the LEDs are preferably mounted on Fr4 printed circuit boards. Preferably, luminaire 10 having a 3500 lumen output has two LED boards that have 36 LEDs populated on each of the Fr4 boards for a total of 72 LEDs.

Luminaire 10 having a 7000 lumen output preferably comprises two LED boards, one for each of the first lighting module and the second lighting module. Due to the higher lumen output as compared to luminaire 10 having a 3500 lumen output, the LEDs are preferably mounted on a metal core printed circuit board. Additional heat sinking is provided for the increased heat generated from luminaire 10 having a 7000 lumen output. To provide for this additional heat sinking, metal core printed circuit boards are preferably used. Each luminaire 10 having 7000 lumen output preferably has two LED boards that have 72 LEDs populated on each of the boards for a total of 144 LEDs.

Figure 9:
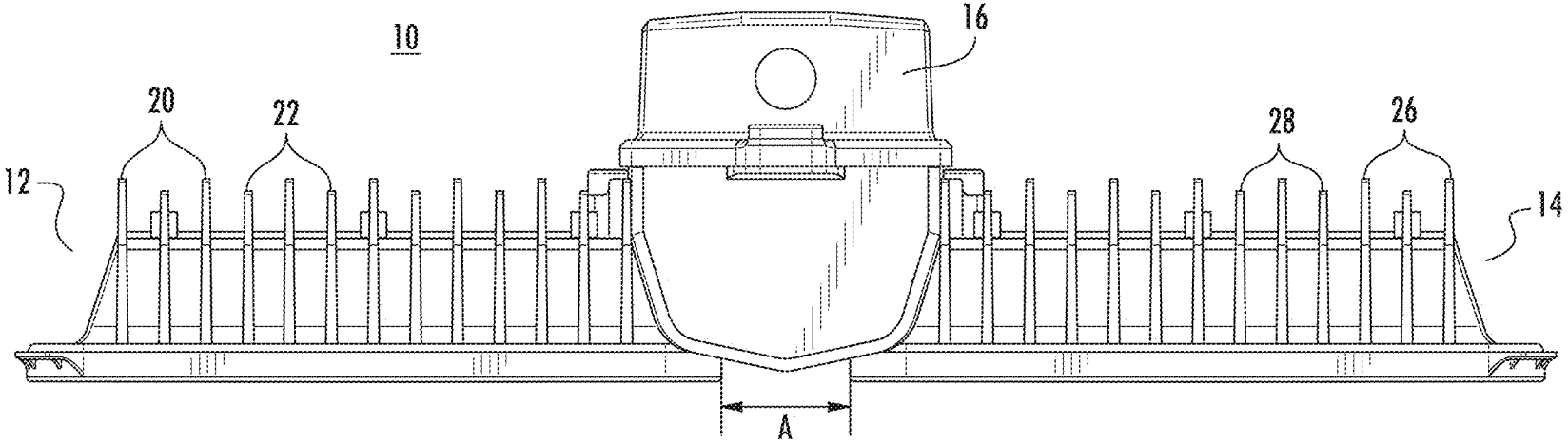
FIG. 9 is a side view of the luminaire of FIG. 1 in accordance with aspects of the invention.

FIG. 9 is a side view of luminaire 10 of FIG. 1 in accordance with aspects of the invention. FIG. 9 illustrates the alternating heat sink fins 20, 22 and 26, 28 as well as horizontal spacing "A" between first lighting module 12 and second lighting module 14.

Figure 10:
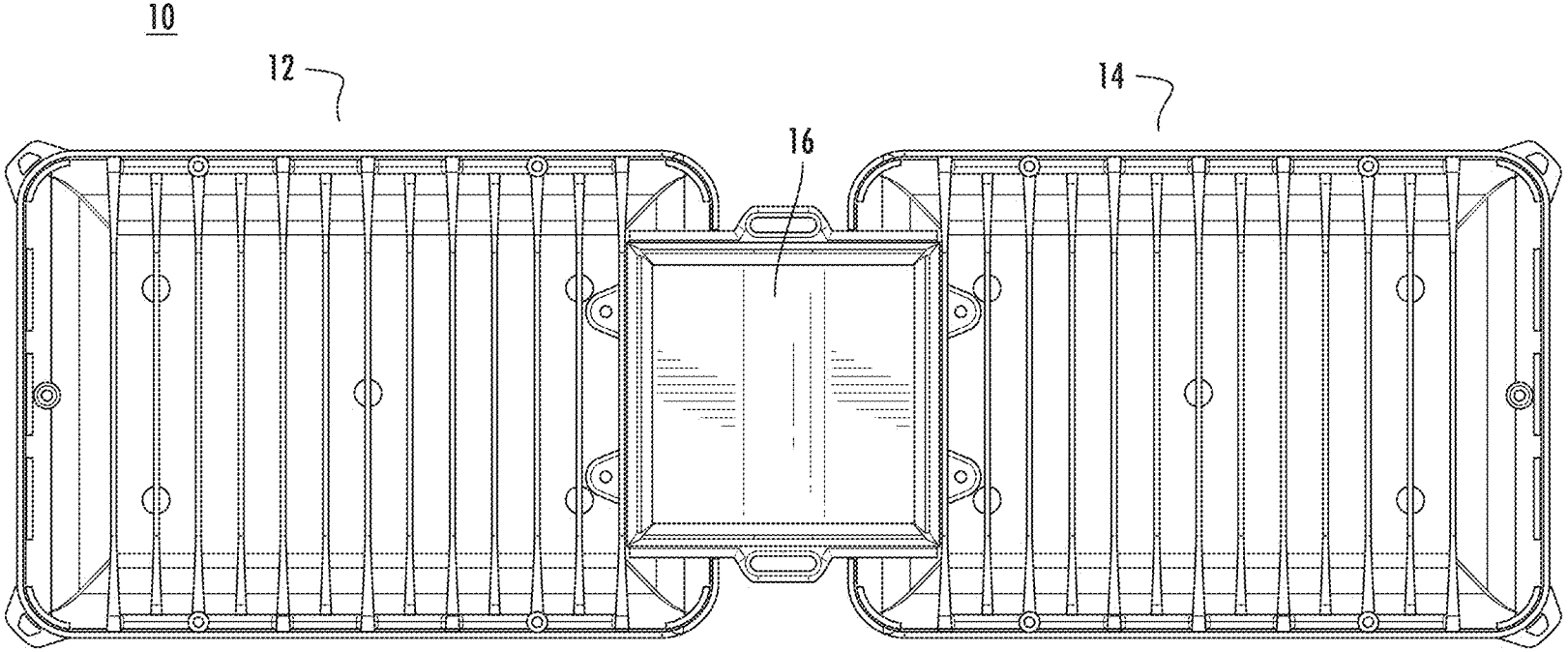
FIG. 10 is a top view of the luminaire of FIG. 1 in accordance with aspects of the invention.

FIG. 10 is a top view of luminaire 10 of FIG. 1 in accordance with aspects of the invention. As shown in FIG. 10, luminaire 10 comprises a junction box 16, first lighting module 12 and second lighting module 14.

Among the features of the invention, the luminaire is vapor-tight. The luminaire has an IP66 rating which does not allow for heat vents in the housing to dissipate heat. Luminaire 10 preferably has gaskets on all mating surfaces to prevent the ingress of dust or water from high pressure spray. As a requirement of an IP66 rating, all areas that house electronics must be sealed to prevent ingress of water or dust.

Figure 11:
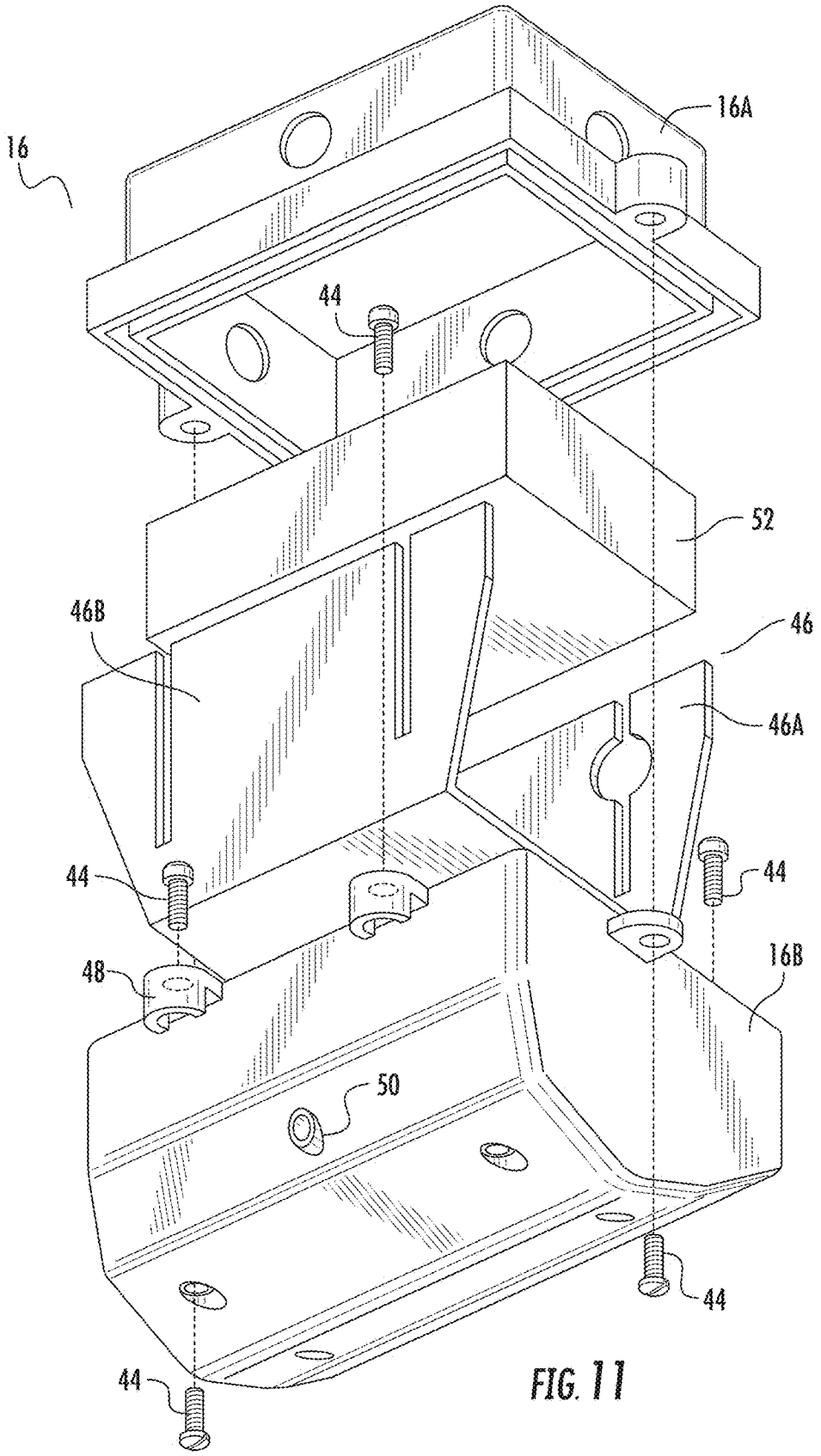
FIG. 11 is an exploded view of the junction or driver box of FIG. 1 in accordance with aspects of the invention.
Figure 12:
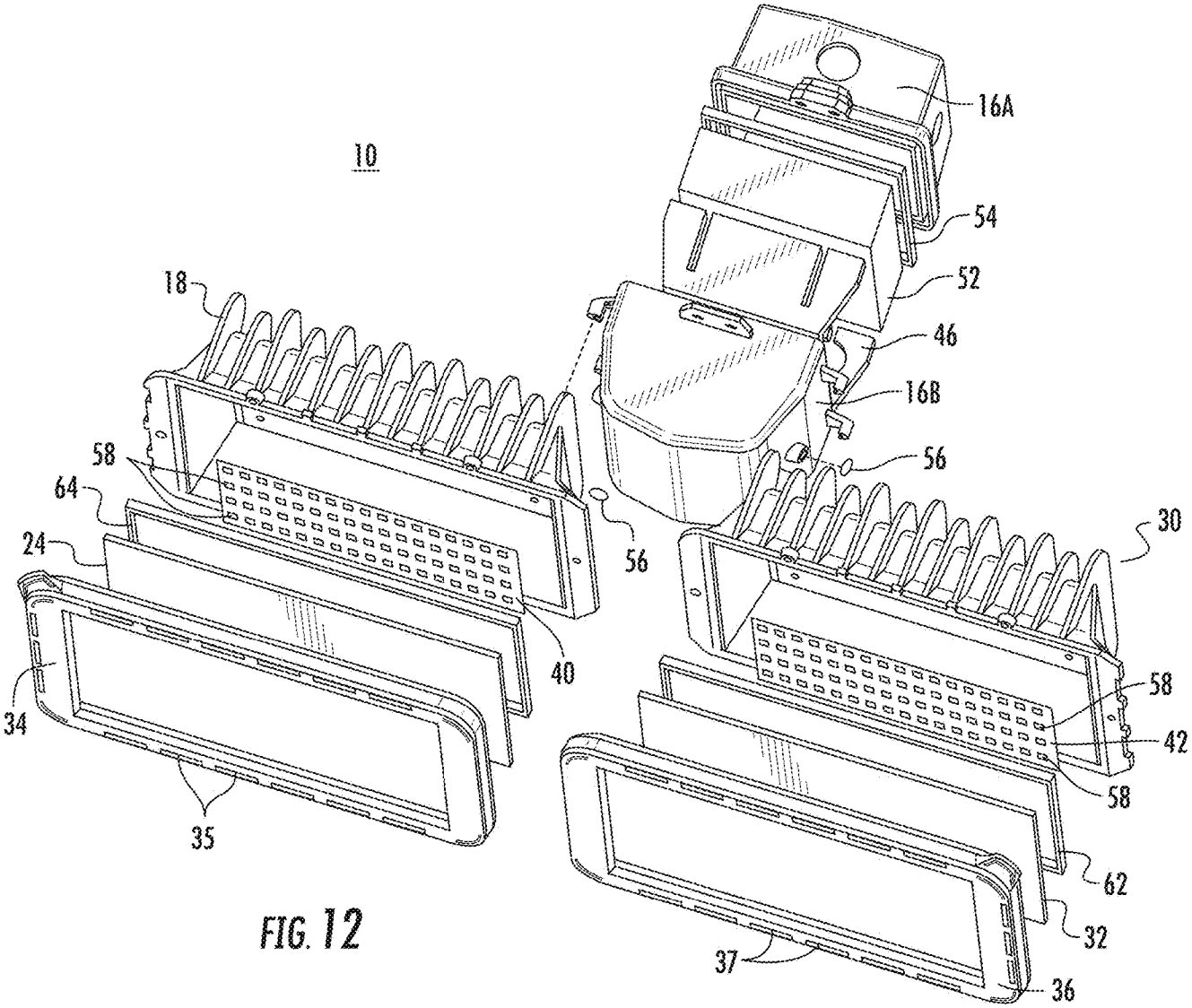
FIG. 12 is an exploded view of the luminaire of FIG. 1 in accordance with aspects of the invention.

FIG. 11 is an exploded view of junction or driver box 16 of luminaire 10 having a 7000 lumen output in accordance with aspects of the invention. As shown in FIG. 11, junction box 16 generally comprises a junction box top cover 16A, a LED driver 52, a heat transfer mounting plate 46 having at least one side(s) 46A, 46B, a junction box bottom cover 16B, and one or more connection devices 44 (such as bolts, pins, or screws) for assembly of junction box 16. A gasket (as shown in FIG. 12) is preferably present between top cover 16A and bottom cover 16B. Bottom cover 16B has cupped top fins 48. Connection devices 44 go into the fins 48. A side cam 50 for wiring purposes is shown on bottom cover 16B. A cable (not shown) between top cover 16A and bottom cover 16 B may be present to hang the luminaire while wiring.

FIG. 12 is an exploded view of luminaire 10 of FIG. 1 in accordance with aspects of the invention. As shown in FIG. 12, a gasket 54 is present between junction box top cover 16A and junction box bottom cover 16B. One or more other gaskets 56 may be present between junction box 16 and first housing 18 and/or between junction box 16 and second housing 30. Preferably, the gaskets are molded silicone gaskets. First housing 18 and second housing 30 each comprise at least one printed circuit board(s) 40, 42 having LEDs 58 mounted thereon. Another gasket(s) 64, 62 attach to the first housing 18 and second housing 30, respectively. Lens diffusers 24, 32 fit within lens frames 34, 36, respectively. Lens frame 34 comprises at least one weep hole, 35 and lens frame 35 comprises at least one weep hole 37.

As shown in FIGS. 11 and 12, luminaire 10 having a 7000 lumen output has a heat transfer plate 46 to dissipate the heat away from the LED driver 52 to outside surfaces of junction box 16. A 7000 lumen output luminaire 10 has twice the amount of lumen output as compared to a 3500 lumen output luminaire 10. Increased lumen output may be achieved by using twice the amount of LEDs but in turn creates more heat and needs more power to operate. This increased amount of power requires a larger LED driver power supply mounted inside of the sealed junction box. Increased lumen output creates more heat that has to be dissipated. It is advisable to keep LED driver 52 at a temperature not to exceed the specifications of the LED manufacturer so as to maximize the life of the LEDs. The heat transfer mounting plate 46 is preferably comprised of aluminum. The heat transfer mounting plate 46 has at least one, preferably two, upward turned sides or wings 46A, 46B. The upward turned side(s) of the mounting plate 46 transfer heat away from the LED driver 52 to outside walls of junction box 16. LED driver 52 thus maintains proper operating temperature. Junction box 16 is preferably completely sealed to avoid any ingress of dust or water which makes it difficult to keep LED driver 52 at a desired temperature ranging from approximately 70 to 90 degrees Celsius. An advantage of luminaire 10 is that there are the two lighting modules to dissipate the additional heat generated from the 7000 lumen output luminaire.

It is preferred for the LED driver box 52 to be made of non-thermally conductive material because thermally conductive material will not pass the present UL requirements to have a UL5VA flame rating and the −30° C. impact test required for outdoor applications. Luminaire 10 is comprised of multiple different plastics. This is advantageous to meet this UL requirement and still obtain the desired performance characteristics of the luminaire.

As a feature of the invention, the first and/or second housing(s) are comprised of a thermally conductive plastic resin or a combination of thermally conductive plastic resins. A thermally conductive plastic resin comprises a base resin material. The base resin material is selected from any number of different plastic resins. Examples of such resins include, but are not limited to, polyphenylene sulfide, polymide, Polycarbonate, Acrylonitrile-Butadiene-Styrene (ABS), Liquid Crystalline Polymer (LCP), thermoplastic elastomer, polyphthalamide, polybutylene terephthalate, and polyaryletheretheketone, and a combination thereof. Different types of resins offer different physical properties. To achieve thermal conductivity, at least one thermally conductive filler such as graphite or boron nitride is added to the base resin to change the thermal properties of the resin. Adding a thermally conductive filler(s) to the base resin can have a dramatic effect on brittleness and impact strength.

In an aspect of the invention, thermally conductive polyphenylene sulfide is preferred as the thermally conductive plastic resin for the first and second housings 18 and 30. The two housings made of this material account for approximately 60-70% of the molded part weight of the luminaire. Polyphenylene sulfide has dimensional stability, heat resistance up to 240 degrees Celsius, and corrosion resistant properties. The thermally conductive plastic resin is preferably injection moldable. This preferred thermally conductive plastic resin meets the F1 UL rating requirements for harsh environments such as salt environments in coastal areas and marine applications as well as in many industrial and commercial environments such as food processing, industrial facilities, and outdoor lighting, among others. Many of these applications use pressure power washing equipment and different cleaning chemicals to wash down the processing area which includes the lighting fixtures. The resin should be selected to protect against corrosive chemical cleaning agents, corrosive salt, and ocean and harsh environments, among others. Luminaire 10 is suitable for outdoor and marine applications as it is particularly desirable to have this F1 UL rating if the luminaire is to be used outdoors for ultraviolet radiation protection.

Another criteria for selection of a thermally conductive plastic resin is that it is of sufficient thermal conductivity to transfer the heat away from the LED light source. Thermal conductivity is the rate at which heat passes through a material, measured in watts per square meter of surface area for a temperature gradient of one Kelvin for every meter thickness. Thermal conductivity is expressed in units of W/mK.

For the luminaire, the thermal conductivity for the thermally conductive plastic resin is measured in two different directions. The first direction being in-plane which transfers the heat in a horizontal orientation and the second direction being through plane which transfers the heat in a vertical orientation. The thermal conductivity for the thermally conductive plastic resin in either direction is in a range of at least 1 W/mK, preferably in a range of 1 W/mK to 40 W/mK, more preferably in a range of 3 W/mK to 20 W/mK.

Another advantage of using thermally conductive plastic resins is that they have lower coefficients of thermal expansion (CTE) than aluminum and can reduce the stress that is transferred to the LED light engine.

Luminaire 10 further comprises a combination of materials that have been strategically selected and placed to greatly reinforce the thermally conductive housing to provide for enhanced strength and durability. The high strength and impact resistance of the Acrylonitrile-Butadiene-Styrene (ABS) is used to trap and seal the bottom surface of the housing and the lens. The lens frames preferably comprise ABS. This material provides added overall strength when attached to the housing. ABS resin is also preferably used on junction box 16 which attaches the two thermally conductive housings. Junction box 16 traps the housing between it and the lens frame by method of a mechanical screw. In an aspect of the invention, wall thicknesses greater that 2.5 mm allow for efficient flow of the thermally conductive plastic resin when molded to eliminate short shots or incompletely filled molds.

Luminaire 10 has a strengthened assembly. Due to the brittle nature of thermally conductive plastic resin, the assembly uses reinforcing measures such as screws suitable for use in plastic assemblies that have increased tightening torque and pull-out force. Such screws are designed for use in plastics to avoid strip out.

Luminaire 10 is mountable in a variety of different ways including surface, pendant, chain or cable, wall, or flood.

Figure 13:
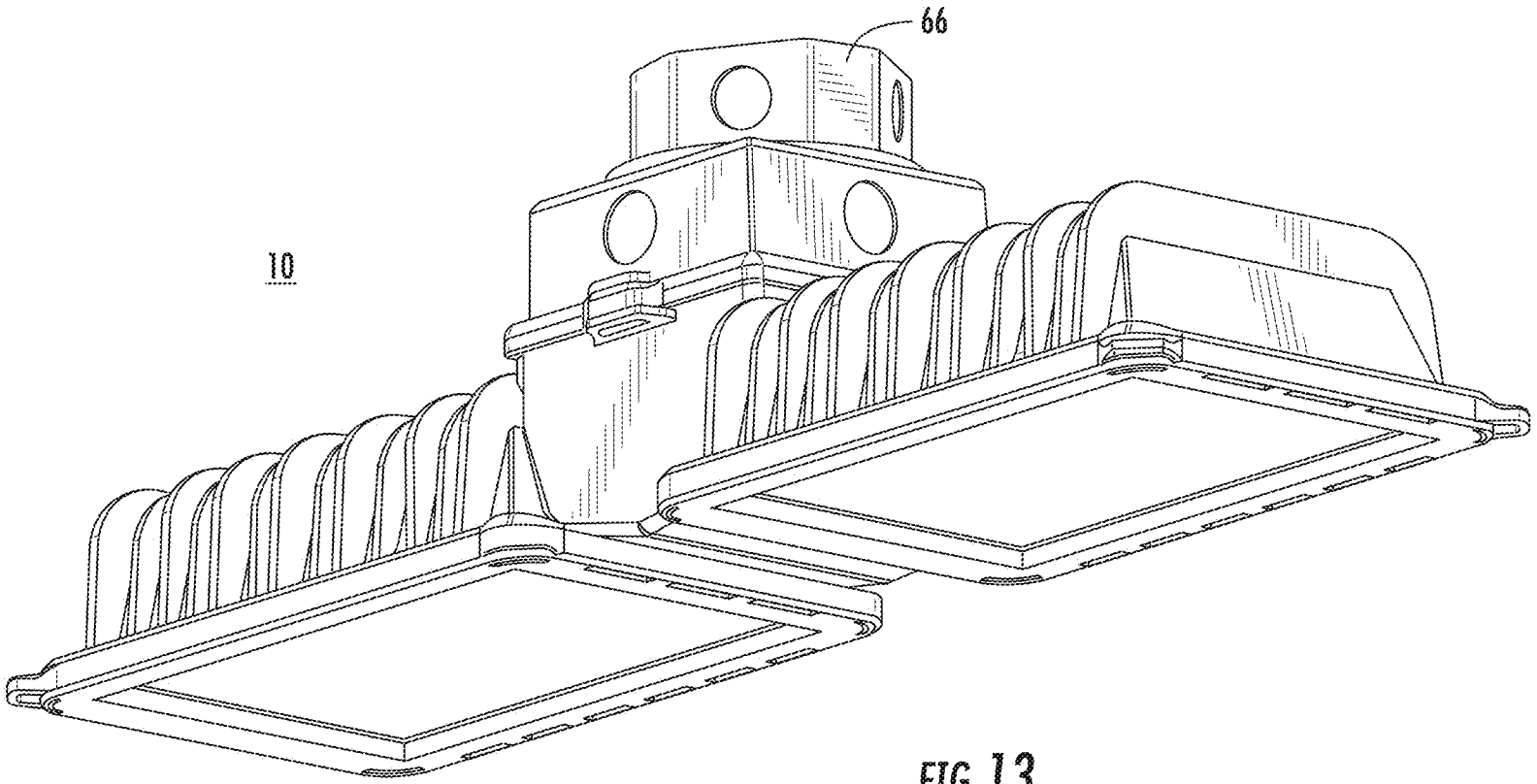
FIG. 13 is a perspective view of a surface mounted luminaire in accordance with the aspects of the invention.

FIG. 13 is a perspective view of a surface mounted luminaire 10 in accordance with the aspects of the invention. A surface mounting device 66 is shown for purposes of mounting luminaire 10 to a surface.

Figure 14:
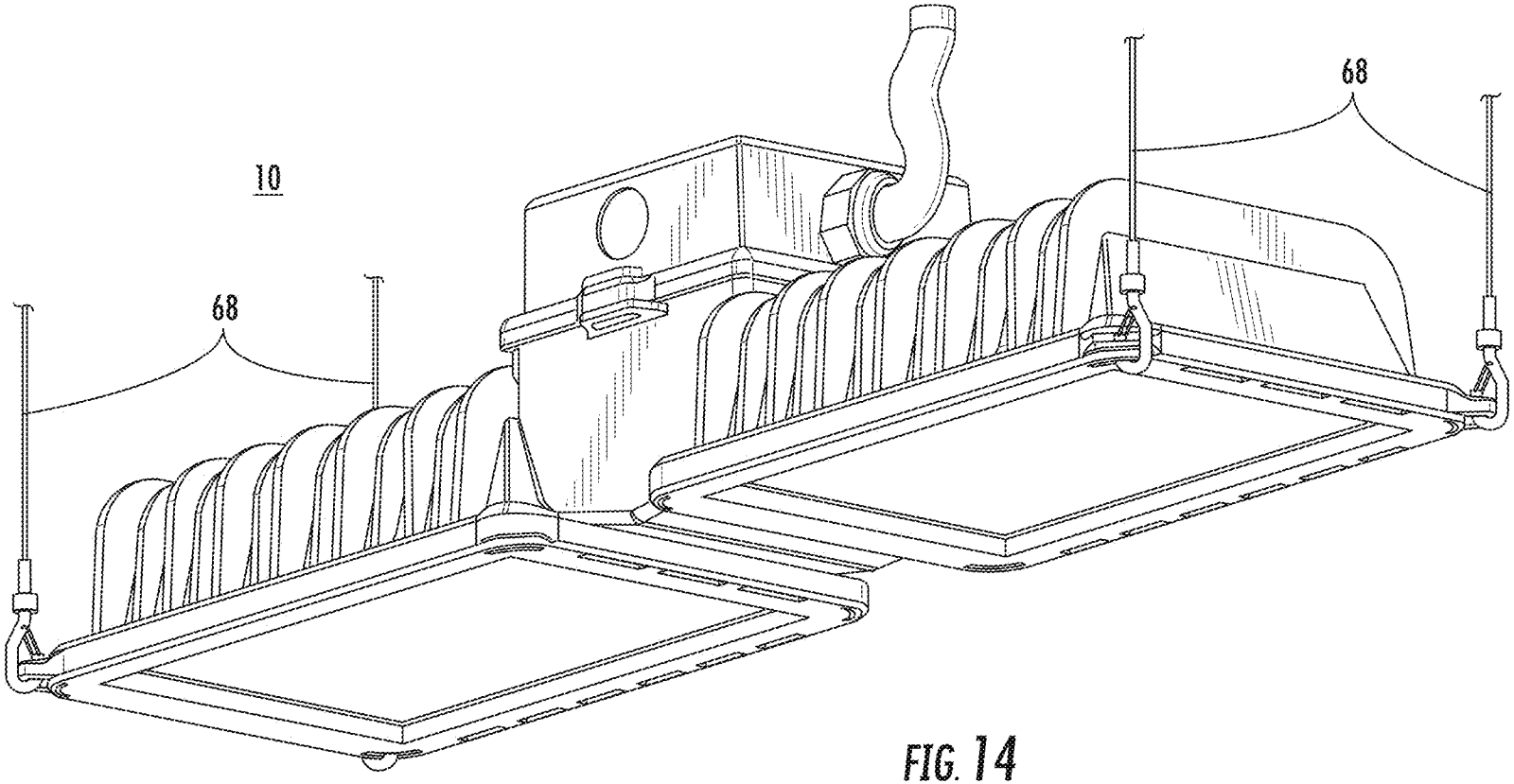
FIG. 14 is a perspective view of a luminaire mounted by cables in accordance with the aspects of the invention.

FIG. 14 is a perspective view of luminaire 10 mounted by cables in accordance with the aspects of the invention. One or more cables 68 are shown for purposes of mounting luminaire 10.

Figure 15:
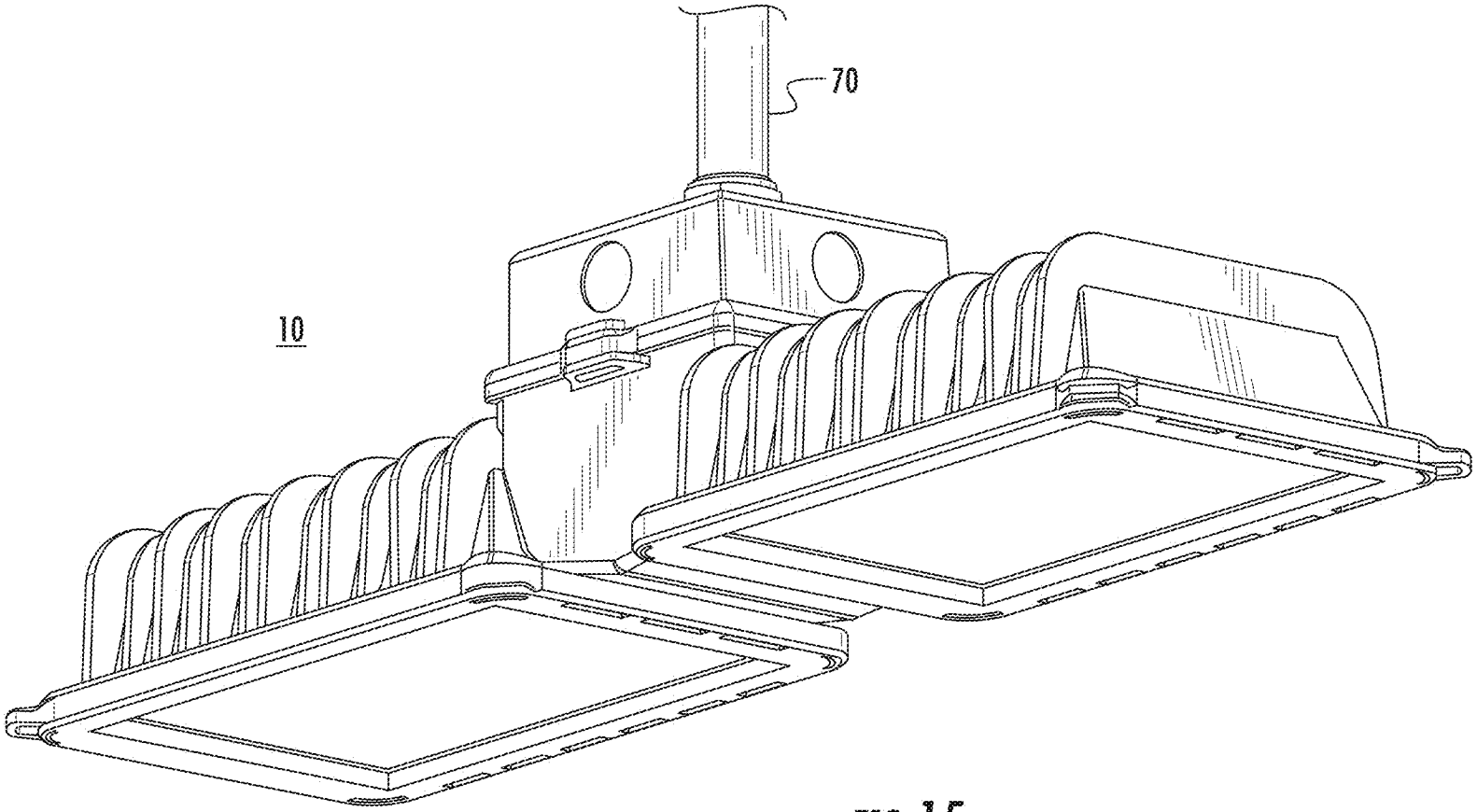
FIG. 15 is a perspective view of a luminaire mounted as a pendant in accordance with the aspects of the invention.

FIG. 15 is a perspective view of a luminaire mounted as a pendant in accordance with the aspects of the invention. A rod 70 is shown for purposes of mounting luminaire 10.

Among the advantages of the luminaire of the invention are its elimination excess weight of the luminaire to facilitate easy installation. The weight of the luminaire as compared to traditional metal fixtures can be more than 50% lighter. There are numerous other advantages associated with the luminaire of the invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A luminaire comprising:

a first lighting module having a first housing with a first set of heat sink fins on the first housing, a second lighting module having a second housing with a second set of heat sink fins on the second housing, a junction box affixed between the first lighting module and the second lighting module, and at least one printed circuit board having a LED located thereon in each of the first housing and the second housing, wherein the first housing, the second housing, or both the first housing and the second housing comprise a thermally conductive plastic resin or a combination of thermally conductive plastic resins.

2. The luminaire according to claim 1, wherein the junction box is raised as compared to the first lighting module and the second lighting module.

3. The luminaire according to claim 1, wherein the heat sink fins are comprised of raised heat sink fins and lowered heat sink fins.

4. The luminaire according to claim 3, wherein the raised heat sink fins and the lowered heat sink fins alternate.

5. The luminaire according to claim 1, wherein the thermally conductive plastic resin or the combination of thermally conductive plastic resins comprises polyphenylene sulfide.

6. The luminaire according to claim 1, wherein the thermally conductive plastic resin comprises a base resin material and at least one thermally conductive filler.

7. The luminaire according to claim 1, wherein the thermally conductive plastic resin has a thermal conductivity in a range of 1 W/mK to 40 W/mK.

8. A luminaire comprising:

a first lighting module having a first housing comprised of a thermally conductive plastic resin with a first set of heat sink fins on the first housing, a second lighting module having a second housing comprised of the thermally conductive material with a second set of heat sink fins on the second housing, a junction box affixed between the first lighting module and the second lighting module, a heat transfer plate housed within the junction box, and at least one printed circuit board having LEDs located thereon in each of the first housing and the second housing, wherein the first housing, the second housing, or both the first housing and the second housing comprise a thermally conductive plastic resin or a combination of thermally conductive plastic resins.

9. The luminaire according to claim 8, wherein the heat transfer plate has an upward side.

10. The luminaire according to claim 8, wherein the heat sink fins are comprised of raised heat sink fins and lowered heat sink fins.

11. The luminaire according to claim 10, wherein the raised heat sink fins and the lowered heat sink fins alternate.

12. A luminaire comprising:

a first lighting module having a first housing with a first set of heat sink fins on the first housing, a second lighting module having a second housing with a second set of heat sink fins on the second housing, a junction box affixed between the first lighting module and the second lighting module, at least one LED printed circuit board located in each of the first housing and the second housing, a first lens diffuser in the first lighting module, and a second lens diffuser in the second lighting module.

13. The luminaire according to claim 12, wherein the heat sink fins are comprised of raised heat sink fins and lowered heat sink fins.

14. The luminaire according to claim 13, wherein the raised heat sink fins and the lowered heat sink fins alternate.

15. The luminaire according to claim 12, further comprising a first lens frame for holding the first lens diffuser.

16. The luminaire according to claim 12, further comprising a second lens frame for holding the second lens diffuser.

17. The luminaire according to claim 15, wherein the first lens frame comprises at least one weep hole.

18. The luminaire according to claim 16, wherein the second lens frame comprises at least one weep hole.

19. The luminaire according to claim 15, wherein the first lens frame connects to the first housing.

20. The luminaire according to claim 16, wherein the second lens frame connects to the second housing.

21. The luminaire according to claim 12, wherein the first housing, the second housing, or both the first housing and the second housing comprise a thermally conductive plastic resin or a combination of thermally conductive plastic resins.

22. The luminaire according to claim 21, wherein the thermally conductive plastic resin or the combination of thermally conductive plastic resins comprise polyphenylene sulfide.

23. The luminaire according to claim 21, wherein the thermally conductive plastic resin comprises a base resin material and at least one thermally conductive filler.

24. The luminaire according to claim 21, wherein the thermally conductive plastic resin has a thermal conductivity in a range of 1 W/mK to 40 W/mK.

* * * * *